United States Patent [19]

Prin

[11] 4,243,171

[45] Jan. 6, 1981

[54] CARRIER FOR PACKING AND CARRYING ARTICLES

[76] Inventor: Jean-Claude Prin, 44 avenue Gallieni, 10300 - Sainte Savine, France

[21] Appl. No.: 33,803

[22] Filed: Apr. 26, 1979

[30] Foreign Application Priority Data

May 25, 1978 [FR] France ..... 78 1552

[51] Int. Cl.[3] ..... B65D 5/46; B65D 33/08

[52] U.S. Cl. ..... 229/52 B; 229/17 G; 229/54 R

[58] Field of Search ..... 229/54 R, 52 B, 17 G

[56] References Cited

U.S. PATENT DOCUMENTS

| | | | |
|---|---|---|---|
| 1,629,852 | 5/1927 | Wolf | 229/54 R X |
| 1,876,982 | 9/1932 | Lichter | 229/54 R X |
| 2,379,665 | 7/1945 | Stone | 229/52 B |

FOREIGN PATENT DOCUMENTS

| | | | |
|---|---|---|---|
| 831456 | 3/1960 | United Kingdom | 229/54 R |

*Primary Examiner*—Stephen P. Garbe

*Attorney, Agent, or Firm*—Fisher, Christen & Sabol

[57] ABSTRACT

A collapsible carrier for articles which is made from a single blank of cardboard folded to provide an automatically positioned bottom with the front and back faces joined by two extendible side gussets, is provided with handle means at the top which includes openings in the front and back faces with a flap, integrally formed with one face, which folds over the other face and has an opening which registers with the other openings with a tongue which folds into locking engagement, the folds in the gussets permitting either a continuous taper of the front and back faces from the bottom or permits the taper to begin at some higher point in the carrier.

4 Claims, 9 Drawing Figures

CARRIER FOR PACKING AND CARRYING ARTICLES

The present invention relates to a bag-shaped box or carrier for packing and carrying articles, offered for example by shop-keepers to their clients to carry their purchases.

A carrier is already known for packing and carrying articles, which comprises a bag composed of a rectangular bottom, two large flat opposite faces and two extendible side gussets and provided with gripping means at its end opposite said bottom. This known carrier is constituted by strong paper and can only be made by hand, particularly as the gripping means have to be joined to said bag, for example in the form of a reinforcing strip glued around the opening of the bag and fast with ties forming a handle. The cost price thereof is therefore high and it can only be used for packing and carrying luxury products. Moreover, its mechanical strength is limited and it may tear when the objects carried therein are heavy and/or angular. Finally, it cannot offer two different packing volumes.

It is an object of the present invention to remedy these drawbacks by providing a bag-shaped box which is strong and of low cost price.

To this end, according to the invention, the carrier for packing and carrying articles, of the type comprising a bag composed of a rectangular or square bottom, two opposite main faces and two extendible side gussets and provided with gripping means at its end opposite said bottom, said carrier being made in the form of a box by folding and gluing a single blank made of a material which is both supple and rigid, such as cardboard, and said gripping means being constituted by a system of openings and flap, forming an integral part with said blank and ensuring that the upper edges of the opening of the bag come together and that the bag is closed, said extendible side gussets being provided with longitudinal lines of fold, characterised in that the side gussets are provided with at least one set of intermediate transverse lines of fold enabling them to give the bag, as desired, either a section which tapers continuously from the bottom to the gripping means, or a constant section between the bottom and said intermediate lines of fold then a section continuously tapering from said intermediate lines of fold to the gripping means.

The bag-shaped box according to the invention may thus be manufactured by known cardboard box making machines, this considerably reducing its cost price. Moreover, as it is made of cardboard, its mechanical strength is good and, due to its intermediate lines of fold, it may offer two different packing volumes.

The invention will be more readily understood on reading the following description with reference to the accompanying drawings, in which.

Figure 1:
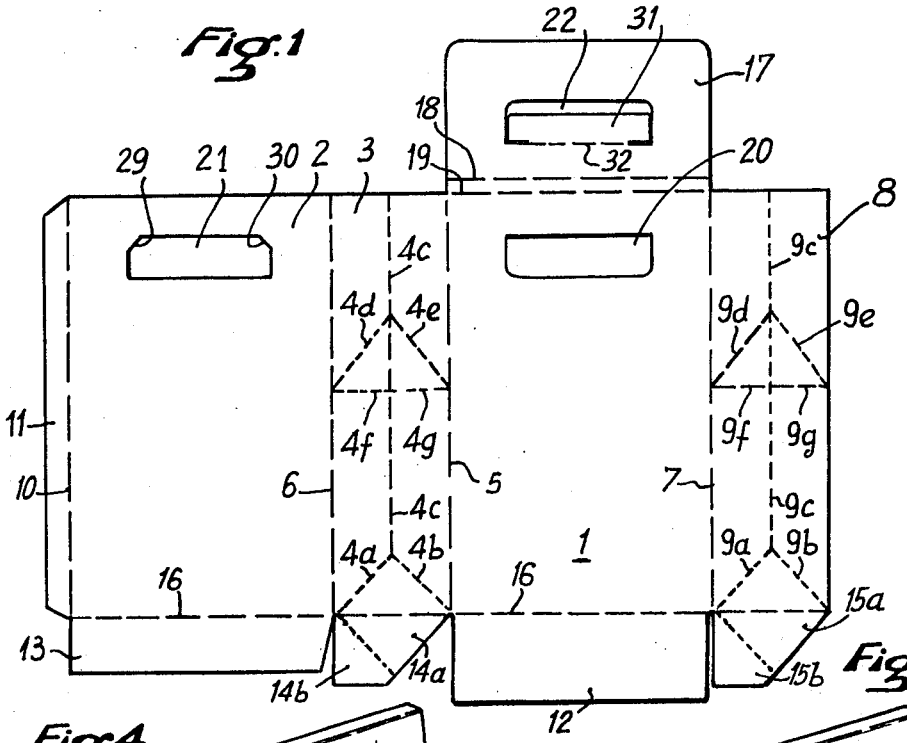
FIG. 1 shows a flat blank for making one type of bag according to the invention.

In these Figures, like references designate like elements. Referring now to the drawings, the cardboard blank, shown in FIG. 1 and intended for making a bag-shaped box according to the invention comprises two main rectangular faces 1 and 2, connected together by a side face 3 in which lines of fold 4 are made, intended to give said side face 3 the form of an extendible gusset when said bag is used. To this end, the lines of fold 4 comprise two portions **4*a* and 4*b* forming the two sides of an isosceles triangle and provided near the bottom of the box and a portion 4*c*, median with respect to face 3 and extending over the major part thereof. The faces 1 and 2 are respectively connected to the face 3 by lines of fold 5 and 6 which are parallel to each other and to line 4*c*. On the side opposite the side face 3, the main face 1 is connected by another line of fold 7 parallel to lines 5 and 6, to another side face 8, identical to the side face 3 and likewise provided with lines of fold 9*a*, 9*b* and 9*c*, intended to enable it to take the form of an extendible gusset when in use and corresponding respectively to lines 4*a*, 4*b* and 4*c*. Furthermore, on the side opposite the side face 3, the main face 2 is connected, by another line of fold 10 parallel to lines 5, 6 and 7, to a flap 11 adapted to be glued on the inside of the side face 8**, to form the box.

At the bottom of faces 1, 2, 3 and 8 are provided different flaps 12 to 15 foldable along a line of fold 16 perpendicular to lines 5,6, 7 and 10 and adapted to form, in known manner, an automatic bottom, i.e. a bottom which may be flattened in a plane orthogonal to its own plane, but which may be formed spontaneously when the faces of the foldable box to which it belongs are pulled away from each other. To this end, the flaps 12 and 13 are rectangular, whilst flaps 14 and 15 have parts **14*a* and 15*a* in the form of isosceles triangles and parts 14*b* and 15*b* respectively foldable along an isosceles side of said triangles and adapted to be glued on the flaps 13 and 12**.

The top of the face 1 is provided with a flap 17 foldable thereon via two spaced apart lines of fold 18 and 19, parallel to each other and perpendicular to lines 5,6,7 and 10.

Openings 20, 21 and 22 are provided in the faces 1 and 2 and in the flap 17, which are adapted to come into register with one another when the blank is shaped as a box and the flap 17 is folded along lines 18 and 19.

A tongue 31 is provided in the opening 22 of the flap 17, which tongue is foldable along a lower line of fold 32 extending over the intermediate part of said tongue, parallel to lines 18 and 19.

Furthermore, according to an important feature of the present invention, faces 3 and 8, in addition to their system of lines of fold **4*a*, 4*b*, 4*c* and 9*a*, 9*b*, 9*c* which enable them to take the form of extendible gussets tapering from the bottom towards the opening of the bag-shaped box, comprise a system of intermediate lines of fold 4*d*, 4*e*, 4*f*, 4*g* and 9*d*, 9*e*, 9*f*, 9*g*, symmetrical in two's respectively with respect to the median longitudinal lines 4*c* or 9*c***.

The blank of FIG. 1 may thus easily be produced by the conventional machines for making cardboard or like blanks and, on the other hand, may then be folded, for example along lines 6, 7 and 16, to allow the flap 11 to be glued onto the face 8 and parts 14*b* and 15*b* respectively onto flaps 13 and 12. Due to the automatic bottom 12, 13, 14 and 15, a flat blank is then obtained and assembled as shown, from the front and rear, in FIGS. 2 and 3. The boxes according to the invention may easily be stored in this flat position.

Figure 4:
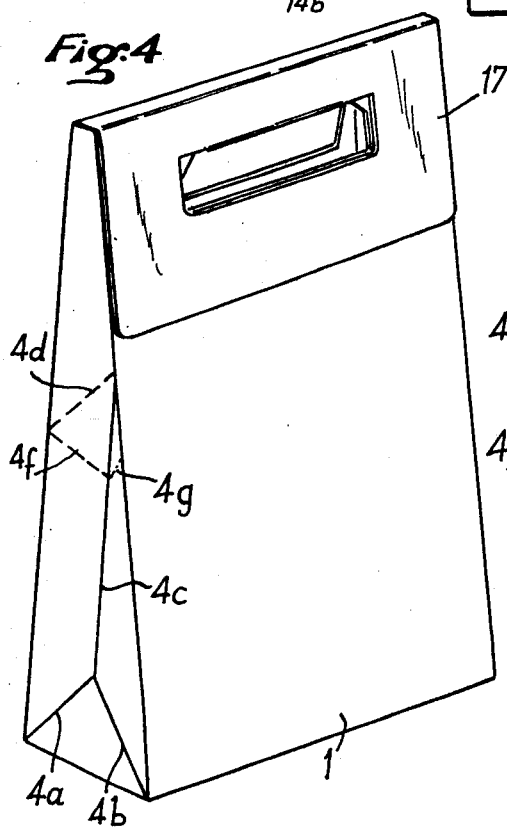
FIGS. 4 and 5 illustrate, in perspective, two modes of using the bag obtained by folding and gluing the blank of FIG. 1.
Figure 5:
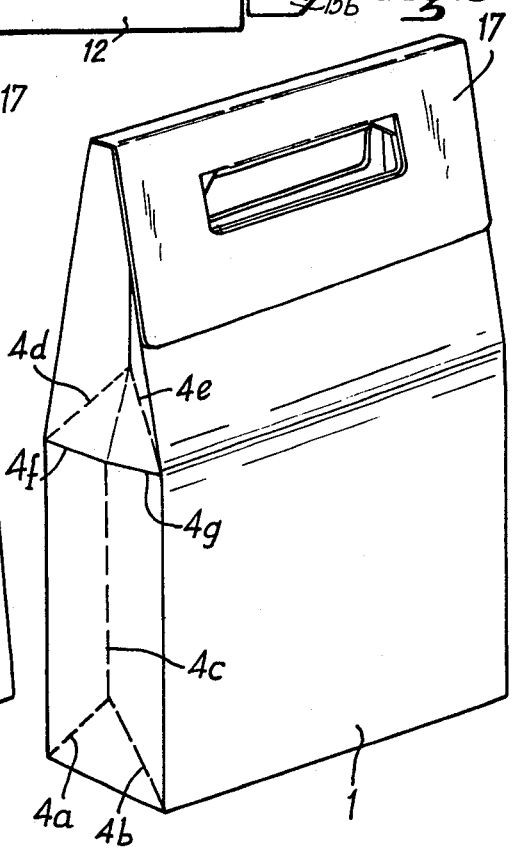
Figure 2:
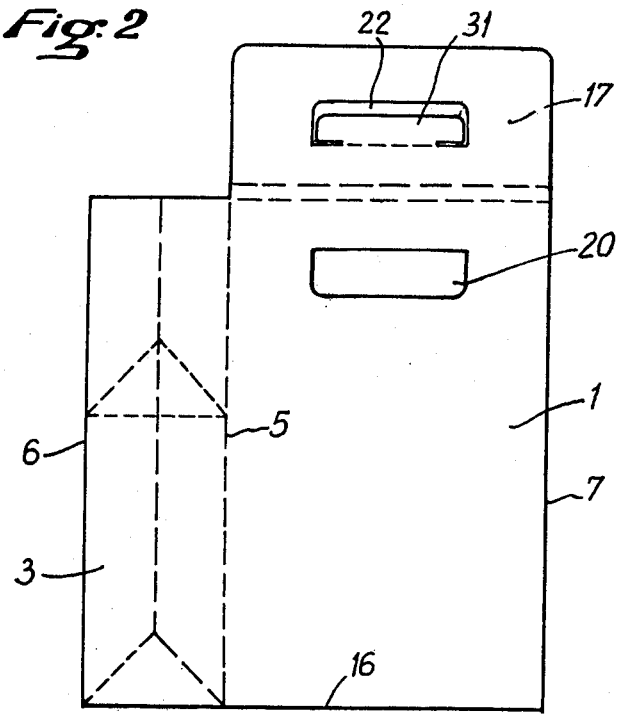
FIGS. 2 and 3 show, from the front and rear respectively, a flat bag obtained by folding and gluing the blank of FIG. 1, when it is stored.
Figure 3:
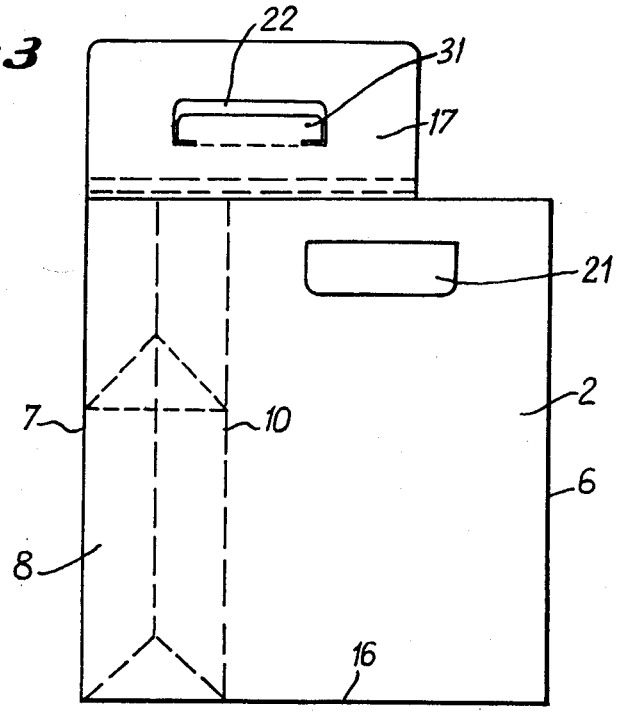

When it is desired to use the box according to the invention, a folded blank assembled as shown in FIGS. 2 and 3 is taken and the faces 1 and 2 are separated from each other by forming angles at the lines of fold 5, 6, 7 and 10 so as to obtain a parallelepipedic box open at the top. At this moment, the automatic bottom comes into position and the articles to be packed and/or carried are placed in the box according to the invention. When said articles are in place, the opening of said box is closed by folding down the flap 17 and pressing the upper edges of the faces 1 and 2 towards each other. Moreover, the tongue 31 is folded down through the openings 20 and 21 which are then in register. The bag-shaped box according to the invention may then take the general form as shown in FIG. 4; the systems of lines of fold 4*a*, 4*b*, 4*c* and 9*a*, 9*b* 9*c* enable the faces 3 and 8 to form extendible gussets tapering from the bottom to the opening of the box. In this case, the lines of fold 4*d*, 4*e*, 4*f*, 4*g* and 9*d*, 9*e*, 9*f*, 9*g* remain in the plane of the parts of the gussets in which they are made and the bag-shaped box according to the invention is such that its section tapers continuously from the bottom to the top thereof. On the other hand, it is also possible for the lines 4*f*, 4*g* and 9*f*, 9*g* to form convex folds in the corresponding parts of the gussets, whilst lines 4*d*, 4*e* and 9*d*, 9*e* form concave folds in said parts. In this case, the bag-shaped box according to the invention takes the form as shown in FIG. 5, the section of the box being rectangular and constant between its bottom and the groups of lines 4*d*, 4*e*, 4*f*, 4*g* and 9*d*, 9*e*, 9*f*, 9*g* and tapering continuously between said groups of lines and the top of said box. Thus, it is possible to choose the outer shape of the box, giving it either the shape shown in FIG. 4 or the shape shown in FIG. 5, as desired and as a function of the shape and size of the articles contained therein.

Figure 6:
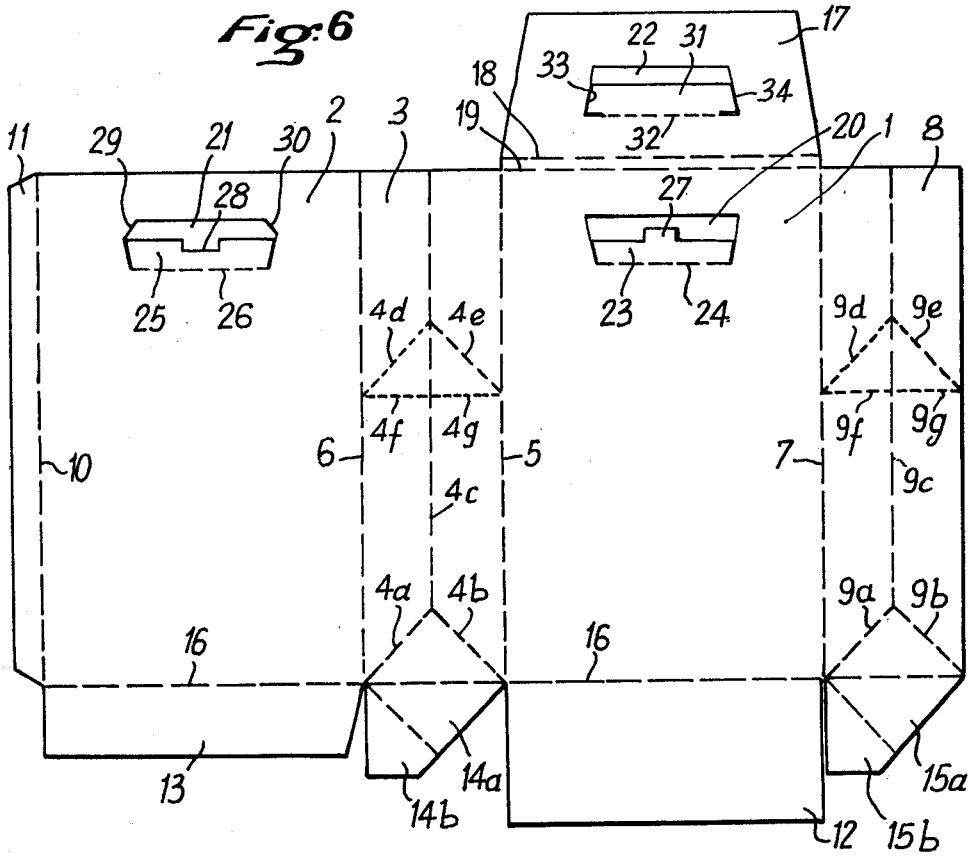
FIG. 6 shows a variant embodiment of a flat blank for making a second type of bag according to the invention.
Figure 7:
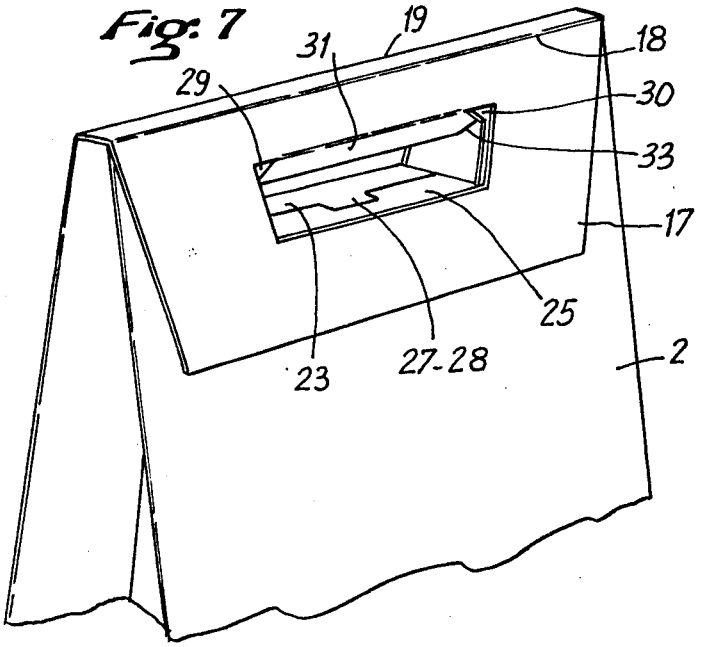
FIG. 7 illustrates, in perspective, the top of the bag, obtained by folding and gluing the blank of FIG. 6, when it is used.

In the variant embodiment of FIGS. 6 and 7, the side edges 33 and 34 of the tongue 31 are upwardly convergent. Moreover, in the opening 20 there is provided a tongue 23 foldable along a lower line of fold 24 extending over the intermediate part of said tongue, parallel to line 16. Similarly, a tongue 25 is provided in the opening 21, which is foldable along a lower line of fold 26 extending over the intermediate part of said tongue parallel to line 16. The tongues 23 and 25 are provided with elements 27 and 28 adapted to cooperate with each other to lock said tongues in folded position. Furthermore, the side edges 29 and 30 of the upper part of the opening 21 are oblique and convergent.

When the box is in position of use (cf. FIG. 7), the flap 17 is folded down on the face 2 by being folded along lines 18 and 19 and the openings 20, 21 and 22 are in register with one another. The tongues 23 and 25 are folded towards each other and the means 27 and 28 are made to cooperate in order to fix them to each other. These tongues therefore enable the box to be closed at the level of openings 20, 21 and 22.

Furthermore, the tongue 31 is folded inwardly and upwardly so that its oblique edges 33 and 34 cooperate respectively with the edges 29 and 30 of the opening 21 to ensure locking of said tongue in position. This locking also ensures the locking of the flap 17 on the face 2.

Thus, the openings 20, 21 and 22 define, in the faces 1 and 2 and in the flap 17, a handle enabling the bag-shaped box to be gripped in the hand. It will be noted that this handle is particularly comfortable due to the folded tongue 31, which avoids contact of the hand with the upper edges of the openings 20, 21 and 22.

Figure 8:
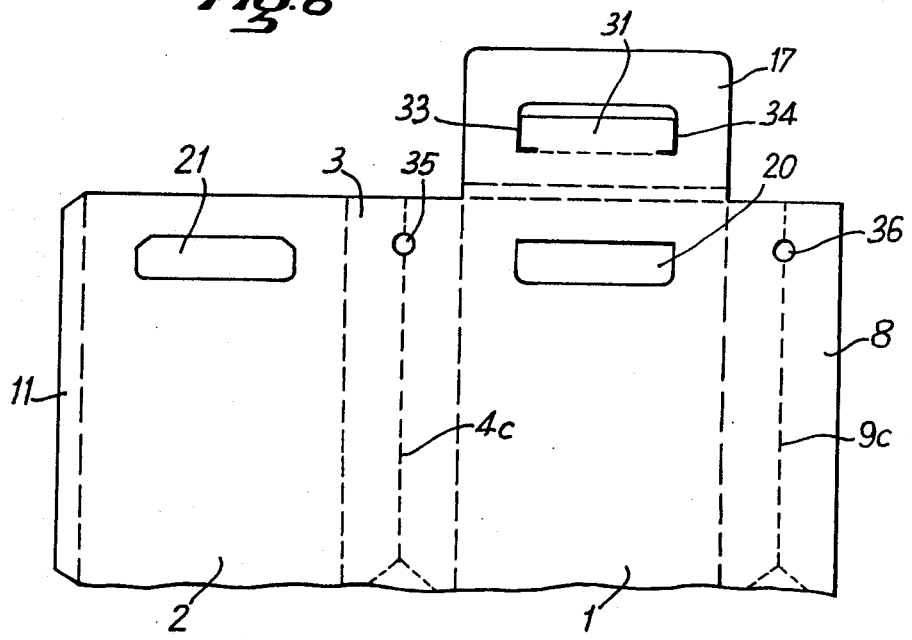
FIG. 8 shows another variant blank, flat, for making a third type of bag according to the invention.
Figure 9:
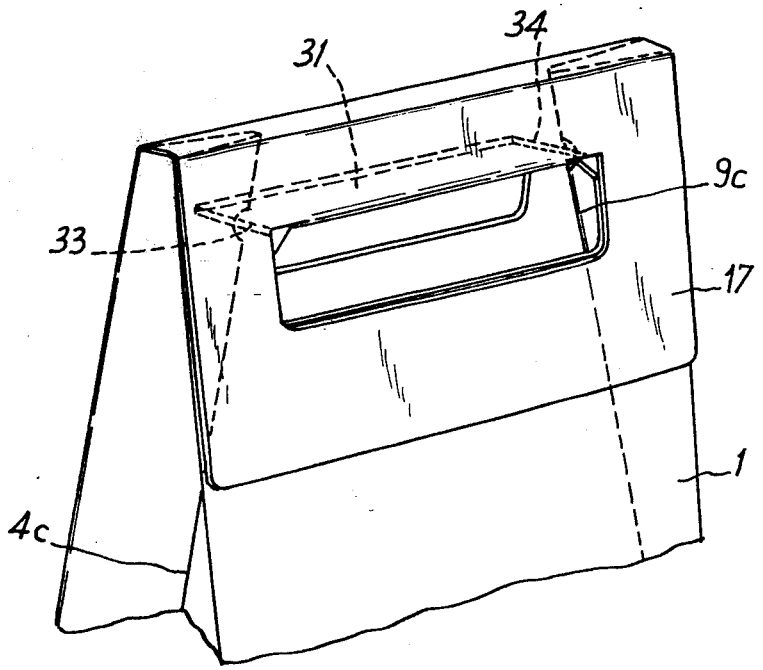
FIG. 9 is a partial view in perspective of the top of the bag obtained by folding and gluing the blank of FIG. 8, in position of use.

In the variant embodiment shown in FIG. 8, cut-outs 35 and 36, for example circular, are provided on the lines of fold 4*c* and 9*c*, so as to form notches in which the side edges 33 and 34 of the tongue 31 elastically clip when said tongue is folded inwardly and upwardly. The locking of this tongue 31 and therefore of the flap 17 is, in this case, therefore obtained by the cooperation of the lateral edges 33 and 34 with the notches 35 and 36 (cf. FIG. 9). Of course, the width of the tongue 31 (from edge 33 to edge 34) must then be larger than the distance separating the fold 4*c* from fold 9*c*, when the box according to the invention is in position of use.

I claim:

1. In a carrier for packing and carrying articles, of the type comprising a bag composed of a rectangular or square bottom, two opposite main faces and two extendible side gussets and provided with gripping means at its end opposite said bottom, said carrier being made in the form of a box by folding and gluing a single blank made of a material which is both supple and rigid, such as cardboard, and said gripping means being constituted by a system of openings and a flap, forming an integral part with said blank and ensuring that the upper edges of the opening of the bag come together and that said bag is closed, said extendible side gussets being provided with longitudinal lines of fold, wherein the side gussets are provided with at least one set of intermediate transverse lines of fold enabling them to give the bag, as desired, either a section which tapers continuously from the bottom to the gripping means, or a constant section between the bottom and said intermediate lines of fold then a section continuously tapering from said intermediate lines of fold to the gripping means, the improvement in which said gripping means comprises three openings in registry, made respectively in the two main faces and the flap while, in the opening of the flap, there is provided a foldable tongue adapted to take a position which is substantially parallel to said bottom, said tongue being joined by a fold line to one margin of said opening in the flap and being locked in the openings in the main faces by cooperative engagement of the opposite end margins of the tongue with notches provided in the folds of the extendible side gussets.

2. A bag-shaped box as claimed in claim 1, wherein said main faces include foldable tongues each joined by a fold line to a respective margin of each of said openings in said main faces and adapted to close said bag at said openings.

3. A blank of cardboard or like material for obtaining a bag-shaped box of the type comprising a box composed of a rectangular or square bottom, two opposite main faces and two extendible side gussets and provided with gripping means at the end opposite said bottom being constituted by a system of openings and a flap, said blank comprising two main faces joined by fold lines to an intermediate panel intended to form one of said extendible side gussets, another intermediate panel joined to the opposite side of one of the main panels by another fold line intended to form the other of the extendible side gussets, a marginal flap joined by a fold line to a side margin of one of the main faces, three openings provided respectively in the main faces and said marginal flap intended to be disposed in registry to form the gripping means, a tongue joined by a fold line to one margin of the opening in the marginal flap, said intermediate panels being provided with at least one set of intermediate transverse fold lines enabling the box to have a sectional configuration which tapers continuously from the bottom to the gripping means, or a constant section between the bottom and said intermediate fold lines then a section tapering from the intermediate fold lines to the gripping means, each of said intermediate panels also being provided with a central fold line, each fold line including an aperture for engagement with a corresponding end margin of said tongue to lock it in position substantially parallel with said bottom in the erected condition of said box.

4. A blank as claimed in claim 3, wherein a tongue is joined by a fold line to a respective margin of each of the openings in said main faces and adapted to close the bag at said openings.

* * * * *